United States Patent [19]

Cha et al.

[11] Patent Number: 5,041,209

[45] Date of Patent: Aug. 20, 1991

[54] PROCESS FOR REMOVING HEAVY METAL COMPOUNDS FROM HEAVY CRUDE OIL

[75] Inventors: Chang Y. Cha, Golden, Colo.; John E. Boysen; Jan F. Branthaver, both of Laramie, Wyo.

[73] Assignee: Western Research Institute, Laramie, Wyo.

[21] Appl. No.: 378,933

[22] Filed: Jul. 12, 1989

[51] Int. Cl.[5] ..... C10G 17/00

[52] U.S. Cl. ..... 208/251 R; 208/390; 208/400; 208/424; 208/434; 208/427

[58] Field of Search ..... 208/390, 424, 427, 434, 208/251 R, 400

[56] References Cited

U.S. PATENT DOCUMENTS

| | | | |
|---|---|---|---|
| 1,897,617 | 2/1933 | Mekler . | |
| 1,954,866 | 4/1934 | Egloff | 208/400 |
| 3,844,934 | 10/1974 | Wolk | 208/107 |
| 3,910,834 | 10/1975 | Anderson | 208/400 |
| 3,936,371 | 2/1976 | Ueda et al. . | |
| 4,234,402 | 11/1980 | Kirkbride . | |
| 4,521,292 | 6/1985 | Spars et al. | 208/427 |

*Primary Examiner*—Helane E. Myers
*Attorney, Agent, or Firm*—Browdy and Neimark

[57] ABSTRACT

A process is provided for removing heavy metal compounds from heavy crude oil by mixing the heavy crude oil with tar sand; preheating the mixture to a temperature of about 650° F.; heating said mixture to up to 800° F.; and separating tar sand from the light oils formed during said heating. The heavy metals removed from the heavy oils can be recovered from the spent sand for other uses.

8 Claims, 1 Drawing Sheet

PROCESS FOR REMOVING HEAVY METAL COMPOUNDS FROM HEAVY CRUDE OIL

FIELD OF THE INVENTION

The present invention relates to a process for removing heavy metal compounds from heavy crude oil using tar sand.

BACKGROUND OF THE INVENTION

Heavy oils require a substantial amount of cracking in order to be economically refined to produce usable products. One major problem affecting the economics of refining heavy oils is the fact that many of these oils contain metal compounds which poison the catalysts used to crack the oil. If heavy oils could be upgraded without sacrificing the usable product yield or without adversely affecting the economics of oil refining as catalyst poisoning does, many new sources of oil products could be developed in the western hemisphere.

Vanadium is present in high concentrations in the Boscan crude oil, and a significant amount of this metal exists in the crude in the form of vanadyl porphyrin chelates. Since porphyrins are detectable in crude oils even at low concentrations using ultraviolet-visible spectrum analysis, and since the vanadyl porphyrins are notorious for their stability and survivability, vanadyl porphyrin behavior and atomic vanadium balances can be used to determine the metal's behavior in the refining of Boscan crude oil.

An alternative oil source that could be used to provide oil products is tar sands. However, the tar sand resources generally produce a heavy oil product that also requires significant upgrading to produce usable products. The high costs of mining the tar sand, extracting the raw tar sand bitumen, and refining the tar sand bitumen to produce salable products are major economic obstacles to be overcome before commercial development of most tar sand resources can occur.

If the technology could be developed to upgrade these heavy crude oils economically without sacrificing the product oil yield, both heavy crude oil and tar sand derived oil could be economically delivered to consumers in the United States. New processing technologies are needed to increase oil yield from heavy oil and tar sands, wherein a minimum of upgrading for these products is required, and high value by-products can be generated during the processing.

Experiments have been conducted using a recycle oil pyrolysis process extraction process with Asphalt Ridge tar sand and heavy oil which show that high yields of light oil products, similar to products generated in crude oil refining, can be obtained from these resources. Additionally, the heavy oil residue from this process contains a high concentration of nitrogen and asphaltenes, which are desirable for asphalt binders.

The operating conditions of the process also create an environment where compounds containing metals can be removed by deposition on the spent tar sand. The spent tar sand then becomes a suitable source for production of these metals. The lower selling price of heavy oil as compared to lighter oils, the creation of valuable by-products, and the ability to remove metals from the heavy oil result in a process with improved commercial potential for these resources at lower financial risk.

A number of processes have been designed to remove heavy metals from crude oil, with varying degrees of success Ueda et al., in U.S. Pat. No. 3,936,371, disclose a method for removing vanadium, nickel, sulfur, and asphaltenes from heavy hydrocarbon oil by contacting the heavy oil with red mud and maintaining this mixture at elevated temperatures in the presence of hydrogen.

Kirkbride, in U.S. Pat. No. 4,234,402, discloses a process for removing sulfur from coal or petroleum comprising drying the coal and subjecting the dried coal in a hydrogen atmosphere to the influence of wave energy in the microwave range.

Mekler, in U.S. Pat. No. 1,897,617, discloses a process for refining hydrocarbon distillates containing mercaptans by subjecting the distillate to the action of X-rays.

SUMMARY OF THE INVENTION

It is an object of the present invention to overcome the aforementioned deficiencies in the prior art.

It is another object of the invention to provide a method for producing valuable light oils from heavy oils and tar sands.

It is a further object of the present invention to provide a method for removing heavy metals from heavy oils.

It is yet another object of the present invention to provide a method for producing heavy metals from heavy oils.

It is still a further object of the present invention to provide a method for producing improved asphalt binders.

According to the present invention, a mixture of tar sand and heavy crude oil is preheated to about 650° F. and introduced into a horizontal screw reactor and then pyrolyzed at the temperature range of 650° to 800° F. The oil vapors and gas produced in the pyrolysis reactor flow into the condenser where oil is separated from gas. The mixture of solid residue and unconverted heavy oil is fed into an inclined screw reactor. The unconverted heavy oil is separated from solid residue in the inclined screw reactor and flows into the heavy oil tank and then is recycled to the pyrolysis reactor after heated to about 800° F. The solid residue separated from heavy oil is heated to about 930° F. in the inclined screw reactor to remove heavy oil remaining on the solids. Solid residue and product gas are burned in an inclined fluidized bed combuster to generate process heat. Heavy metals in the heavy crude oil are deposited onto the spent sands, producing upgraded oil and an improved asphalt binder.

DETAILED DESCRIPTION OF THE INVENTION

Figure 1:
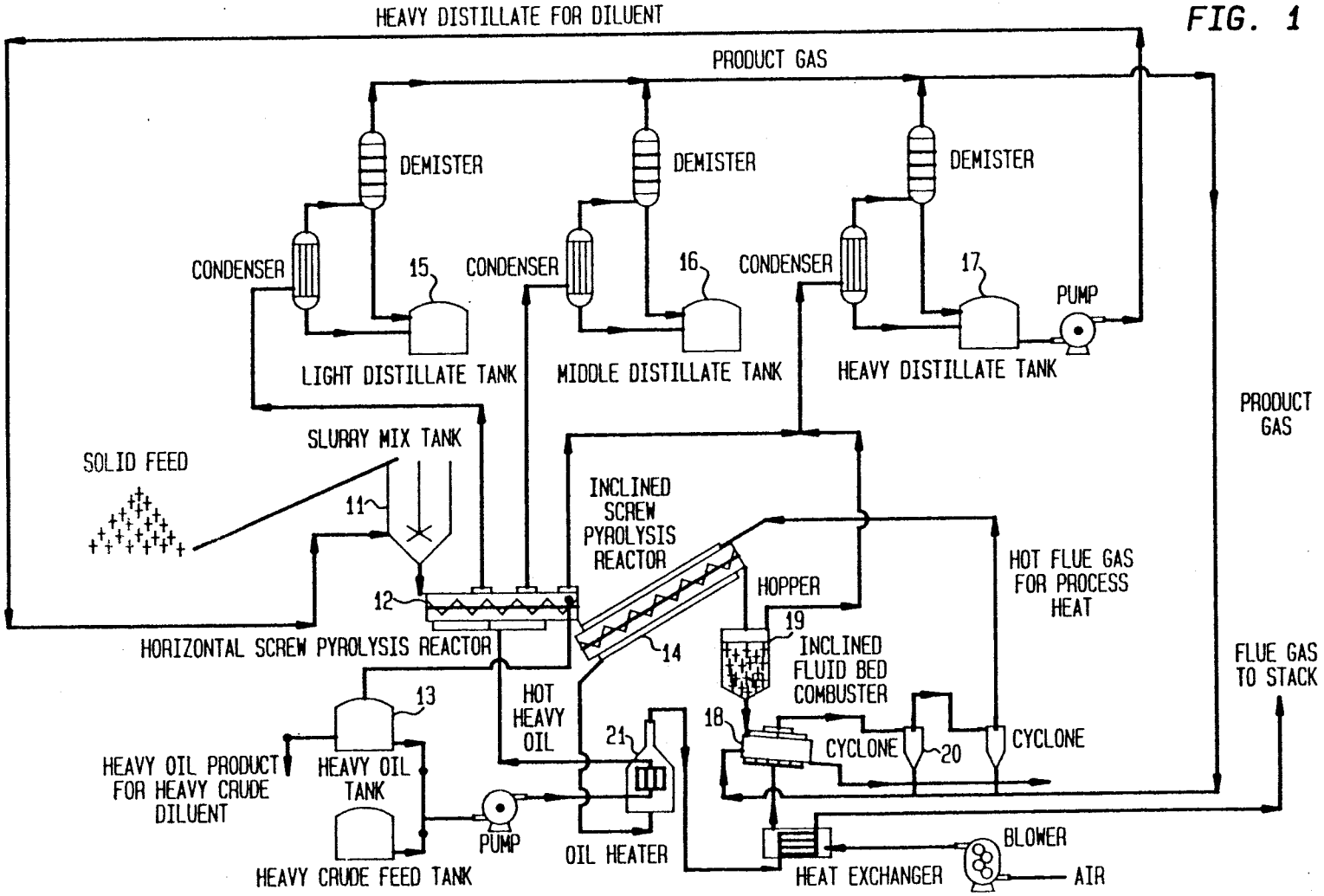
FIG. 1 shows a process flow diagram for use in the process according to the present invention.

The present invention provides a process wherein heavy crude oil and tar sand are processed together to remove heavy metals from the heavy crude and produce light oil that may be used as diluent for heavy oil production and transportation. The metal complexes are removed from the oil and concentrated in the solid residue obtained in the process. The feed stocks are then refined to produce light oils with favorable hydrogen to carbon ratios.

FIG. 1 shows an overall process flow diagram for coprocessing tar sand with heavy crude oil. Crushed and screened tar sand is mixed with heavy distillates product in a feed hopper 11. The mixture of solid and product oil is heated in the feed hopper and then fed into the horizontal pyrolysis screw reactor 12. High heat capacity fluid heating system (not shown in FIG. 1) is used to heat the materials in the feed hopper and horizontal pyrolysis screw reactor.

The mixture of bitumen, product oil, and sand flows into the pyrolysis reactor and is mixed with the heated mixture of recycled heavy oil and heavy crude oil. The material in the pyrolysis reactor is heated with the recycle heavy oil. The bitumen and heavy oil are pyrolyzed in the reactor to produce lighter oil. The oil vapor flowing from the first section of reactor is condensed in the condenser and collected in the light distillate tank 15. The oil vapors flowing from the middle and last section of the reactor are condensed in the condensers and collected in the middle (16) and heavy distillate tank (17), respectively. A part of the heavy distillate is recycled to the feed hopper to soak the solid feed. The product gas flows into the inclined fluidized-bed combuster 18 and is burned with spent sand to provide heat needed for the process. The liquid oil product (heavy oil) flows out of the bottom of the horizontal pyrolysis reactor and is collected in the heavy oil tank 13. This heavy oil is an improved asphalt binder. If this heavy oil is not used as the asphalt binder, it will be recycled to the horizontal pyrolysis reactor. Heavy crude oil and heavy product oil are pumped through the oil heater and then flow into the horizontal pyrolysis reactor.

The retorted (pyrolyzed) solid material is separated from the heavy oil and fed into an inclined screw pyrolysis reactor 14. The heavy oil absorbed on the solid material and unconverted organics in the solids are recovered by heating with hot gas and the recycled hot spent sand from the inclined fluidized-bed combuster to about 930° F.

The solids leaving the inclined screw pyrolysis reactor are collected in a cyclone 19 which serves as the feed hopper for the inclined fluidized-bed combuster. The product gas and oil vapor produced in the inclined screw pyrolysis reactor and cyclone 19 flow to the heavy distillate condenser. The cyclone is well insulated to minimize the heat loss and equipped with double valves to prevent the combustion gas flow from the combuster to pyrolysis reactor.

Hot retorted solid material and product gas are fed into the inclined fluidized-bed combuster 18 and burned by the heated air. The burned solids are discharged from the combuster to a cyclone separator 20. The hot flue gas is separated from the solids in the cyclone and leaves the top of the cyclone separator. A part of the burned solids are recycled to the inclined screw pyrolysis reactor and the remainders are conveyed for cooling and disposal.

In order to remove the sulfur-containing gases from the hot flue gas, a dry sorbent such as limestone is added to the inclined fluidized-bed combuster. As a result, the flue gas needs not be treated by a separate system. The organic residue in the retorted solids and product gas provides sufficient heat for the process, although additional fuel can be added to the inclined fluidized-bed combuster.

The inclined fluidized bed reactor used in the present invention is useful in overcoming the problem of nonuniform residence times of particles which have different sizes, which is common when using conventional, vertical, fluidized beds. Cold-flow tests using solid tracers have verified that the inclined fluidized bed is a plug-flow reactor. The reactor retains the desirable characteristics of fluidized beds such as high heat transfer rates, good mixing, high throughput, and no moving parts, while it also has the capability for uniform residence times of different-sized particles and nonisothermal operation.

The plug-flow reactor which is particularly well suited to the process according to the present invention is described in more detail in application Ser. No. 07/116,327, filed Nov. 3, 1987 now abandoned, and which is hereby incorporated by reference.

A preliminary investigation of the benefits of coprocessing tar sand and heavy crude oil containing substantial amounts of metal complexes was conducted. This investigation sought to determine if the coprocessing of these materials has potential for future commercial oil production of these resources.

The two objectives of this preliminary investigation were to determine, by basic novel concept research, if the metal complexes, which adversely affect catalytic refining of these heavy crudes, could be reduced or removed by coprocessing with tar sand and if these heavy oil resources (tar sand bitumen and metal bearing heavy crude oils) could be refined during the coprocessing to produce high yields of usable products.

A two inch diameter screw pyrolysis reactor such as shown in FIG. 1 was used to conduct the preliminary research for coprocessing Asphalt Ridge tar sand and Boscan crude oil using the process of the present invention. Asphalt Ridge tar sand was selected for the tar sand because it is a U.S. resource that is economically suited to surface mining. Boscan crude oil was selected because its notoriously high vanadium content makes it a worst case metal bearing heavy crude oil. If this worst case crude oil can be successfully processed, then any heavy crude oil containing high concentrations of vanadium and other heavy metals should also be suitable for coprocessing and upgrading using the process of the present invention.

A first experiment was designed to determine the metal concentrations in the process products and spent sand for the tar sand alone without the presence of the vanadium rich Boscan crude. This experiment used Asphalt Ridge tar sand feed and a non detergent S.A.E. 50 weight motor oil as the heavy oil. The experimental duration was 24 hours, and samples were collected to evaluate the process contribution of the tar sand. The tar sand feed was sampled, as were the three product oil fractions, the product gas, the produced water, the produced heavy oil, and the spent sand. This experiment was designated SPR86.

A second experiment was designed to determine the metal concentrations in the process products and spent sand from coprocessing tar sand and vanadium rich Boscan crude oil. The experiment was conducted using the same Asphalt Ridge tar sand feed and a heavy oil that comprised 36% Boscan crude oil and 64% heavy oil produced from the experiment SPR86. The duration of this experiment was 24 hours, and product sampling was similar to that of the above-described experiment.

The two experiments were conducted over a period of 48 hours of continuous operation of the screw pyrolysis reactor. During the first 24 hours of the operation, the motor oil was injected as heavy oil and recirculated through the reactor. After 24 hours of operation, the heavy oil injection tank was drained and refilled with a mixture of Boscan crude oil and SPR86 heavy oil. The amounts of spent sand and heavy oil in the reactor at the time when the injection of the heavy oil mixture containing the Boscan crude was initiated were estimated by imposing ash and organic balances on the data. The accumulation was then incorporated into the balances for SPR87 and individual atomic balances for each of the two experiments were conducted to confirm the validity of the estimates. The material and atomic balances for the two experiments were then compared to determine the behavior of the Boscan crude injected during SPR87.

The porphyrin content of the samples was determined by the method of Bean, *The Analysis of Porphyrins in Boscan Crude,* Ph.D. Dissertation, University of Utah, Salt Lake City, Utah, 1961. An ultraviolet-visible (uv-vis) spectrum of a chloroform solution of each sample was obtained on a Beckman DB spectrophotometer. The area under each peak at 390–410 nm was integrated and compared with a standard sample of known porphyrin content.

Metal analyses were obtained by ashing and decomposing each sample to remove silicates and carbon. Residual materials from this process were then dissolved, and metal concentrations were determined by inductively coupled plasma spectrometry (ICP).

Light oils were dewatered by contacting them with anhydrous magnesium sulfate, followed by centrifugation. Heavy oils were diluted with toluene and centrifuged to remove solid mineral matter. Water was azeotropically removed along with the toluene.

The bitumen contents of the tar sand and spent sand were determined by extraction with toluene and pyridine. Coke values for the tar sand and spend sand were determined by heating the residual solids to 900° F. (482° C).

Elemental analyses and proximate analysis analyses were performed using standard methods.

EXAMPLE 1

This experiment was conducted in the 2 inch screw pyrolysis reactor using Asphalt Ridge tar sand and non-detergent S.A.E. 50 weight motor oil as an initial heavy oil. Additionally, a small quantity of product oil from a previous experiment was added to the initial tar sand charge to reduce the viscosity of the feed. This was not necessary in later tar sand charges because sufficient product oil had been produced for recycle purposes. The product oil from the previous experiment that was added was accounted for in the experimental material and atomic balances. Further, all product yield data presented herein is on a net production basis, so that all oil added initially is not considered in the yield.

Table 1 presents a summary of the overall material balance and the carbon, hydrogen, and vanadium elemental balance closures for experiments SPR86 and SPR87. The agreement is quite good.

TABLE 1

Summary of Experimental Material, Carbon, Hydrogen, and Vanadium Balance Closures

| Balance | % Closure SPR86 | % Closure SPR87 |
|---|---|---|
| Overall Materials | 100.1 | 100.2 |
| Carbon | 99.6 | 97.4 |
| Hydrogen | 96.6 | 97.2 |

TABLE 1-continued

Summary of Experimental Material, Carbon, Hydrogen, and Vanadium Balance Closures

| Balance | % Closure SPR86 | % Closure SPR87 |
|---|---|---|
| Vanadium | 99.2 | 95.6 |

Table 2 summarizes the net conversion of the bitumen in the tar sand feed into products. 92.3% of the total bitumen in the tar sand feed was converted into heavy oil, light product oil, and combustible gas. The remaining bitumen was retained in the sand either as oil or coke. The data shown in Table 2 are used to determine the contribution of the tar sand feed to the products of experiment SPR87.

TABLE 2

Process Yield Summary for Experiment SPR86
Processing of Asphalt Ridge Tar Sand with Motor Oil

| Material | Weight (grams) | % of Feed |
|---|---|---|
| Feed: | 6927 | 100.0 |
| Tar Sand Bitumen | | |
| Products: | | |
| Net Heavy Oil Product | 1302 | 18.8 |
| Net Light Oil Product | 4645 | 67.1 |
| Net Gas Produced | 445 | 6.4 |
| Spent Sand: | | |
| Net Coke Increase | 302 | 4.4 |
| Oil Remaining | 233 | 3.3 |

The atomic hydrogen/carbon ratios for the tar sand bitumen, motor oil, and the heavy and light product oils for experiment SPR86 are presented in Table 3. These data illustrate the degree to which the feed materials were upgraded by the process of the present invention.

TABLE 3

Atomic H/C of Bitumen and Oils from Experiment SPR86
Processing of Asphalt Ridge Tar Sand with Motor Oil

| Material | Atomic H/C |
|---|---|
| In: | 1.61 |
| Tar Sand Bitumen | 1.61 |
| S.A.E. 50 wt. Oil | 2.02 |
| Out: | |
| Heavy Oil Product | 1.88 |
| Light Oil Product (KO#1) | 2.01 |
| Light Oil Product (KO#2) | 1.91 |
| Light Oil Product (KO#3) | 1.89 |

EXAMPLE 2

The second experiment conducted in the two inch screw pyrolysis reactor involved coprocessing Asphalt Ridge tar sand and a heavy oil mixture containing a portion of the heavy oil produced in SPR86 and Boscan crude oil.

The results of this experiment, SPR87, were encouraging because of the deposition of vanadium onto the spent sand matrix. The balance closures for this experiment are presented in Table 1. The balance closures presented for experiment SPR87 are very similar to those presented for experiment SPR86.

TABLE 4

Process Yield Summary for Experiment SPR87 Coprocessing of Asphalt Ridge Tar Sand and Boscan Crude Oil

| Material | Weight (grams) | % of Feed |
|---|---|---|
| Feed: | | |
| Tar Sand Bitumen | 7284 | 39.2 |
| Boscan Crude Oil | 11246 | 60.6 |
| Bitumen Remaining on Spent Sand | 43 | 0.2 |
| Products: | | |
| Net Heavy Oil Product | 6614 | 35.6 |
| Net Light Oil Product | 10545 | 56.8 |
| Net Gas Produced | 485 | 2.6 |
| Spent Sand: | | |
| Net Coke Increase | 592 | 3.2 |
| Oil Remaining | 337 | 1.8 |

Table 4 summarizes the product conversion of the bitumen in the tar sand feed and the Boscan crude oil. 57% of the total of the bitumen and the Boscan crude oil was converted into light product oils. Only 5% of the total bitumen and crude oil was retained on the spent sand in the form of either coke or oil.

Table 5 was constructed using the data in Tables 2 and 4. The data presented in this table illustrate the individual contributions of the tar sand bitumen and the Boscan crude oil to the net experimental product yield. This table was constructed by assuming that the tar sand bitumen in this experiment was converted to products in a fashion similar to the product conversion achieved in experiment SPR86, as shown in Table 2. The conversion of the Boscan crude to products was then considered to be the difference between the actual net experimental product yield and the estimated product yield from the bitumen.

TABLE 5

Tar Sand and Crude Oil Contributions to Process Product Yield for Experiment SPR87 Coprocessing of Asphalt Ridge Tar Sand and Boscan Crude Oil

| | Contribution to Yield from: | |
|---|---|---|
| | Tar Sand (grams) | Crude Oil (grams) |
| Products: | | |
| Heavy Oil Product | 1369 | 5245 |
| Light Oil Product | 4884 | 5661 |
| Gas Produced | 468 | 17 |
| Spent Sand: | | |
| Coke Produced | 318 | 274 |
| Oil Remaining | 245 | 49 |

A summary of the product yields of the Boscan crude oil that was converted during SPR87 is presented in Table 6. These data illustrate that 53% of the Boscan crude introduced in this experiment was converted to the form of either light product oil, combustible product gas, or coke. Further, over 95% of the Boscan crude oil that was converted formed a light product oil.

TABLE 6

Boscan Crude Oil Yield Data for Experiment SPR87 Coprocessing of Asphalt Ridge Tar Sand and Boscan Crude Oil

| Boscan Crude Oil Converted to: | Weight (grams) | % of Total Crude Oil Converted |
|---|---|---|
| Light Product Oil | 5661 | 95.1 |
| Gas | 17 | 0.3 |
| Coke | 274 | 4.6 |

Table 7 illustrates the upgrading to oil products of the tar sand bitumen and Boscan feeds in experiment SPR87. The atomic hydrogen/carbon ratios for the feed materials and products of the experiment are presented in this table, and those ratios indicated significant increases in the hydrogen/carbon ratios of the experimental light oil products, which accounted for most of the product yield.

TABLE 7

Atomic H/C of Bitumen and Oils from Experiment SPR87 Coprocessing of Asphalt Ridge Tar Sand and Boscan Crude Oil

| Material | Atomic H/C |
|---|---|
| In: | |
| Tar Sand Bitumen | 1.61 |
| SPR86 Heavy Oil Product | 1.88 |
| Boscan Crude Oil | 1.69 |
| Out: | |
| Heavy Oil Product | 1.74 |
| Light Oil Product (KO#1) | 1.99 |
| Light Oil Product (KO#2) | 1.98 |
| Light Oil Product (KO#3) | 1.88 |

The vanadium concentration of the tar sand bitumen and tar sand residue (after bitumen, coke, and silicate extraction) was determined for the Asphalt Ridge tar sand. The results of these determinations indicated that 98.5% of the total vanadium in this tar sand are to be found in the spent sand. Using the data for the tar sand vanadium concentration and analyses of the vanadium concentrations in the Boscan crude oil, the final heavy oil from experiment SPR87, and spent sand from experiment SPR87, the final fate of the vanadium in the Boscan crude converted by coprocessing was determined. Table 8 provides a summary of the vanadium distribution in the products from the coprocessing of the Asphalt Ridge tar sand and the Boscan crude oil. Table 9 provides a summary of the fate of the vanadium originally in the converted Boscan crude oil.

TABLE 8

Vanadium Distribution for Experiment SPR87 Coprocessing of Asphalt Ridge Tar Sand and Boscan Grude Oil

| Material | Vanadium Content | % of Total |
|---|---|---|
| In: | | |
| Tar Sand Feed | 1188 | 8.5 |
| SPR86 Heavy Oil Product | 17 | 0.1 |
| Boscan Crude Oil | 12496 | 90.0 |
| Spent Sand in Reactor | 201 | 1.4 |
| Out: | | |
| Heavy Oil | 7917 | 56.5 |
| Spent Sand (includes Mineral Matter in Heavy Oil) | 5467 | 39.1 |
| Vanadium (unaccounted) | 618 | 4.4 |

TABLE 9

Fate of the Vanadium in the Converted Boscan Crude Oil for Experiment SPR87 Coprocessing of Asphalt Ridge Tar Sand and Boscan Crude Oil

| Mineral | Vanadium Content (mg) | % of Total |
|---|---|---|
| Boscan Crude Converted | 6666 | 100.0 |
| Conversion Products: | | |
| Light Product Oils | 0 | 0.0 |
| Gas Produced | 0 | 0.0 |
| Remaining Heavy oil | 1987 | 29.8 |
| Spent Sand | 4061 | 60.9 |
| Vanadium (unaccounted) | 618 | 9.3 |

In addition, the light product oils and heavy product oil from experiments SPR86 and SPR87 were analyzed for metalloporphyrin content using the direct integral method of Bean (op. cit.). Asphalt Ridge tar sand bitumen has traces of nickel porphyrins and Boscan crude oil has 10.4 micromoles/g of metalloporphyrins, 90% of which are vanadyl porphyrins. The results of the porphyrin analyses of the oils produced from these experiments are presented in Table 10.

TABLE 10

Porphyrin Analyses of Experimental Product Oils

| Product Oil | Porphyrin Content (micromoles/g) Nickel Porphyrin | Vanadyl Porphyrin |
|---|---|---|
| Experiment SPR86: | | |
| Heavy Oil Product | 0 | 0 |
| Light Product Oil (KO#1) | 0 | 0 |
| Light Product Oil (KO#2) | 0 | 0 |
| Light Product Oil (KO#3) | Trace | 0 |
| Experiment SPR87: | | |
| Heavy Oil Product | 0 | 1.75 |
| Light Product Oil (KO#1) | 0 | 0 |
| Light Product Oil (KO#2) | Trace | 0 |
| Light Product Oil (KO#3) | Trace | 0 |

The following observations are based on the data in Tables 8, 9, and 10:

No porphyrins were observed in the heavy oil product from experiment SPR86 because motor oil was used in the experiment.

Traces of nickel porphyrins were found in two of the three light product oil fractions (KO#2 and KO#3) because nickel porphyrins in the tar sand bitumen are capable of transport by volatilization and entrainment at the operating temperatures of the pyrolysis and drying screws. The operating temperature of the preheat screw is not sufficient for this transport to occur; consequently, the nickel porphyrins are not present in the KO#1 light product oil fraction from that experiment.

Boscan crude oil was introduced in the heavy oil used in experiment SPR87, and the porphyrin content of this crude is mostly in the form of vanadyl chelates. Since the initial heavy oil used in this experiment comprised 36% Boscan crude oil, the initial heavy oil contained about 105 millimoles of vanadylporphyrins. Analysis of the final heavy oil from SPR87 indicated the presence of 49 millimoles of vanadyl porphyrins in the oil. Thus, the vanadyl porphyrin content from the Boscan crude oil that was introduced was reduced by 53%. This is very close to the same percentage reduction in vanadyl porphyrin content as the percent of the total Boscan crude oil converted to products. It appears that the vanadyl porphyrin content of the Boscan crude is completely destroyed as the crude is converted using the process of the present invention with the tar sand. The light product oils generated from this experiment have the same porphyrin content (vanadyl and nickel) as the light products from experiment SPR86, indicating that the porphyrin reduction in the heavy oil did not result in increased metal content in the light oils.

The spent sand generated by coprocessing with the Boscan crude oil showed a 390% increase in vanadium concentration over the tar sand residue without coprocessing. Analyses of the results of the vanadium balance for experiment SPR87 indicated that 60.9% of the vanadium in the heavy oil converted to products was deposited on the spent sand (including mineral matter in the heavy oil) during the experiment. Further, the absence of vanadyl porphyrins in the light product oils and the reasonable accountability of the remaining vanadium existing in the heavy oil indicate that a vanadium free light oil product was generated from the Boscan crude oil by coprocessing with tar sand using the process of the present invention. The final distribution of the vanadium in the products from experiment SPR87 indicate that a major portion of the vanadium in the Boscan crude oil is deposited on the spent sand and the remaining amount exists in the heavy oil product.

The observed behavior has significant advantages for commercial use of vanadium rich heavy crude oils. High yields of a light vanadium free oil can be produced along with a heavy oil with high metal content suitable for asphalt binders. The light oil product can also be used as a diluent for heavy oil pipeline transportation. Further, the spent sand may serve as a source for metals production.

Boscan crude oil is a viscous, high-sulfur petroleum of marine origin that has been subjected to biodegradation. The vanadium and nickel contents of this oil are extremely high, as shown in Table 11. About 40% of the vanadium and nickel in Boscan crude oil can be accounted for as porphyrin chelates. Porphyrins in a petroleum are derived from chlorophylls of the plant material from which the crude oils are ultimately derived. These compounds are characterized by great chemical stability and distinctive uv-vis spectra. Because of the uv-vis spectra, porphyrins may be detected in small quantities in mixtures as complex as crude oils.

TABLE 11

Results of Metals Analyses for Asphalt Ridge Tar Sand, Boscan Crude Oil, and Spent Sand Produced from Coprocessing Asphalt Ridge Tar Sand and Boscan Crude Oil

| Material: | Metal Concentration (ppm) Cr | Cu | Fe | Mn | Mo | Ni | V | Zn |
|---|---|---|---|---|---|---|---|---|
| Asphalt Ridge Tar Sand: | | | | | | | | |
| Bitumen | 7.1 | 1.4 | 540.0 | 5.0 | 1.0 | 91.7 | 2.4 | 41.9 |
| Residue | 24.6 | 9.1 | 0.4 | 24.4 | — | 8.4 | 22.3 | 15.2 |
| Boscan crude Oil | 1.3 | — | 17.5 | 0.5 | 3.7 | 104.0 | 1120.0 | 7.1 |
| Spent Sand from SPR87 | 55.1 | 10.8 | 0.4 | 34.5 | 3.9 | 32.6 | 86.9 | 17.8 |

Northwest Asphalt Ridge tar sand is a lacustrine deposit derived from the Green River oil shales. Like Boscan crude oil, this tar sand bitumen is presumably biodegraded. The bitumen is low in sulfur and high in nitrogen. The trace metals in this bitumen comprise substantial amounts of iron, nickel, and zinc, although little vanadium is present, as can be seen from Table 11. Presumably, these metals are incorporated into clay minerals. The bitumen content of the sand is about 12%.

When Boscan crude and Asphalt Ridge tar sand are heated together during the process of the present invention, the conditions are such that some of the metal complexes present in the mixture of bitumen and crude oil decomposed. The metal ions in these complexes, predominantly vanadyl, nickelous, and ferrous ions, were precipitated on the residual sand surface, probably as sulfide.

Vanadyl sulfides have considerably hydrodesulfurization (HDS) and hydrodemetallization (HDM) activities and nickel sulfides have hydrogenation and HDS activities under high hydrogen pressures. The residue of the sand becomes coated with metal sulfides that are generated during the course of the processing. This coated sand bears a small resemblance to sulfided commercial HDS catalysts, which consist of cobalt-molybdenum or nickel-molybdenum sulfides supported on alumina matrices. Clay minerals present in residual sands may provide sites for some catalytic cracking. A metals analysis of the residual solids obtained from the coprocessing of Asphalt Ridge tar sand and Boscan crude oil according to the present invention is also reported in Table 11.

The products obtained from coprocessing Asphalt Ridge tar sand and Boscan crude oil using the process according to the present invention indicate that more than mild thermal cracking is occurring. Analyses of the gas produced from these experiments indicates that the gas contains significant amounts of $C_4$ and $C_5$ hydrocarbons, which are products characteristic of catalytic processes (cf. Table 12). Purely thermal processes produce mostly $C_1$ and $C_2$ hydrocarbons. These lighter hydrocarbons must have resulted from cracking reactions. The $C_5$ hydrocarbons are present in greater abundance in the experiment where the Asphalt Ridge tar sand was coprocessed with the Boscan crude oil, SPR87.

TABLE 12

Summary of Experimental Product Gas Yields

| Gas Component | Mass Produced for Experiment: SPR86 (grams) | SPR87 (grams) |
|---|---|---|
| Hydrogen | 7.0 | 4.2 |
| Carbon Monoxide | 13.0 | 9.1 |
| Carbon Dioxide | 71.3 | 30.3 |
| Methane | 53.3 | 58.0 |
| Ethane | 28.4 | 41.1 |
| Ethylene | 7.1 | 7.8 |
| Propane | 38.9 | 36.0 |
| Propylene | 24.3 | 15.2 |
| $C\text{-}4_s$ | 61.8 | 61.0 |
| $C\text{-}5_s$ | 97.7 | 116.3 |
| Hydrogen Sulfide | 41.8 | 105.9 |
| Total Gas Produced | 444.6 | 484.9 |

Light product oils, from the experiment in which the tar sand was coprocessed with the Boscan crude, contain only traces of nickel porphyrins or none at all. The heavy oil product from this experiment contains 1.75 micromoles/gram of vanadyl porphyrins. Boscan crude oil contains 10.4 micromoles/gram porphyrins, 90% vanadyl. The spent sand from experiment SPR87 contains almost four times the vanadium concentration as the sand in the tar sand feed (cf. Table 11). Thus, a substantial amount of the vanadium complexes in the Boscan crude oil are decomposed during the process of the present invention. The vanadium is probably deposited as a sulfide on the spent sand particles. The vanadium and other metal sulfides probably catalyze some hydrocracking, HDS, and HDM reactions of the heavy organic molecules in converted feedstock. Also, enough hydrogen sulfide, a known hydrogen transfer agent, is present to provide some transfer of hydrogen. If the metal sulfides assist in crude and bitumen decomposition to a significant degree, the product distribution and product quality should be different when the Asphalt Ridge tar sand is coprocessed with the Boscan crude oil instead of the motor oil. The product yield data from experiment SPR87 differ from that of experiment SPR86, but it is difficult to interpret because at the severity of the experimental conditions, the duration of the experiment was not sufficient to convert all of the Boscan crude to products.

The spent sand from the experiment using the Asphalt Ridge tar sand coprocessed with the Boscan crude oil contains a substantial amounts of chromium, and there is a surprising absence of iron in the spent sands from both experiments. While a small amount of chromium is present in the feedstocks, the high chromium content of the spent sand indicates that a small amount of reactor corrosion took place during the experiments. The absence of iron in the spent sand might be due to iron deposition on the walls of the reactor. More likely, the iron may be associated with the oil products.

The light oils produced by coprocessing tar sand and heavy crude oil according to the present invention do not contain vanadyl porphyrins, and the results of an atomic vanadium balance for experiment SPR87 indicate that these oils do not contain any significant amount of vanadium in any chemical form.

The spent sand produced from coprocessing the tar sand and crude oil contains dramatically increased vanadium content (390% increase) compared to the vanadium content of the tar sand feed.

The metal complexes removed from the Boscan crude oil deposit on the spent sand, presumably in the form of metal sulfides. Based upon the gas analyses for experiment SPR87, the metal sulfide containing sand appears to exhibit HDS, HSM, and possibly some hydrocracking activities.

High yields of a light product oil are obtained from Boscan crude oil by coprocessing this crude with Asphalt Ridge tar sand using the process of the present invention. Boscan crude oil is known to have a high residual content, yet over 95% of the Boscan crude oil affected during experiment SPR87 was converted to light product oils.

High yields of oil are also produced from the tar sand bitumen, when the tar sand is coprocessed with oil using the process of the present invention. 85% of the weight of tar sand bitumen feed was converted to product oils when the tar sand was coprocessed with motor oil using the process of the present invention.

The foregoing description of the specific embodiments will so fully reveal the general nature of the invention that others can, by applying current knowledge, readily modify and/or adapt for various applications such specific embodiments without departing from the generic concept, and therefore such adaptations and modifications are intended to be comprehended within the meaning and range of equivalents of the disclosed embodiments. It is to be understood that the phraseology or terminology herein is for the purpose of description and not of limitation.

What is claimed is:

1. A process for removing heavy metal compounds from heavy crude oil consisting essentially of:
   - mixing said heavy crude oil with tar sand;
   - preheating said mixture to a temperature of about 650° F.;
   - pyrolyzing said mixture in a horizontal screw pyrolysis reactor at a temperature of from about 650° to about 800° F. to form oil vapors, product gas, solid residue, and unconverted heavy oil;
   - recovering said oil vapors and gas;
   - introducing said mixture of solid residue and unconverted heavy oil into an inclined fluidized-bed screw reactor;

separating said unconverted heavy oil from said solid residue;

heating said unconverted heavy oil to about 800° F. and recycling said unconverted heavy oil to the horizontal screw pyrolysis reactor heating said solid residue to about 930° F. in an inclined screw pyrolysis reactor to deposit said heavy metal compounds onto spent solids to produce upgraded oil and asphalt binder, and to remove any heavy oil remaining in said solid residue;

burning said solid residue and product gas in an inclined fluidized bed combuster to generate process heat;

separating the heavy metals by collecting the solids onto which the heavy metals have been deposited; and recovering upgraded oil and asphalt binder produced.

2. The process according to claim 1 wherein said heavy crude oil is mixed by flowing the oil cocurrent to said tar sand.

3. The process according to claim 2 wherein said heavy oil flows downwardly at an incline.

4. The process according to claim 1 wherein said heating is effected in three temperature zones.

5. The process according to claim 1 wherein products from the pyrolysis step are separated by reflux condensing.

6. The process according to claim 1 wherein said separated tar sand is heated to remove any oil remaining in said sand.

7. The process according to claim 1 wherein a dry sorbent for sulfur-containing gases is added to the inclined fluidized-bed combuster.

8. The process according to claim 7 wherein the sorbent is limestone.

* * * * *